US007166793B2

(12) United States Patent
Beller

(10) Patent No.: US 7,166,793 B2
(45) Date of Patent: Jan. 23, 2007

(54) COMPACT HUM-CANCELING MUSICAL INSTRUMENT PICKUP WITH IMPROVED TONAL RESPONSE

(76) Inventor: Kevin Beller, 212 Price Rand Rd., Los Alamos, CA (US) 93440

( * ) Notice: Subject to any disclaimer, the term of this patent is extended or adjusted under 35 U.S.C. 154(b) by 0 days.

(21) Appl. No.: 10/764,322

(22) Filed: Jan. 22, 2004

(65) Prior Publication Data

US 2005/0162247 A1 Jul. 28, 2005

(51) Int. Cl.
*G10H 3/00* (2006.01)

(52) U.S. Cl. ..... 84/723; 84/725; 84/728

(58) Field of Classification Search ..... 84/723, 84/725–728, 730–731, DIG. 24
See application file for complete search history.

(56) References Cited

U.S. PATENT DOCUMENTS 4,372,186 A * 2/1983 Aaroe ..... 84/725
4,524,667 A * 6/1985 Duncan ..... 84/728
5,464,948 A * 11/1995 Lace ..... 84/726
5,668,520 A * 9/1997 Kinman ..... 336/84 R
5,789,691 A * 8/1998 Stich ..... 84/726
5,811,710 A * 9/1998 Blucher et al. ..... 84/728
5,834,999 A * 11/1998 Kinman ..... 336/84 R
5,908,998 A * 6/1999 Blucher et al. ..... 84/728
6,103,966 A * 8/2000 Kinman ..... 84/728
6,291,759 B1 * 9/2001 Turner ..... 84/726

* cited by examiner

*Primary Examiner*—Marlon Fletcher
(74) *Attorney, Agent, or Firm*—J. E. McTaggart

(57) ABSTRACT

A two-coil pickup having a magnetic flux shield configuration which shields an upper coil from magnetic flux variations caused by unwanted noise and concentrates this noise flux in a lower coil. The magnetic flux shield also concentrates magnetic flux generated by magnets and which envelopes strings of a stringed instrument in the vicinity of the upper coil. The upper coil and lower coil are coupled so that the noise signal generated in the lower coil is subtracted from the signal generated in the upper coil so as to cancel noise therefrom. The resulting output signal has substantially less noise than a one coil pickup. The shield also allows the lower coil to be smaller such that the overall size of the two coil pickup can be small enough to fit into the cavities formed for traditional one coil pickups.

11 Claims, 8 Drawing Sheets

SECTION A-A
SCALE 3 : 1

ALTERNATIVE EMBODIMENT #2

ALTERNATIVE EMBODIMENT #2

ALTERNATE EMBODIMENT #3

ALTERNATIVE EMBODIMENT -
LAMINATED BOBBIN/SHIELD

COMPACT HUM-CANCELING MUSICAL INSTRUMENT PICKUP WITH IMPROVED TONAL RESPONSE

BACKGROUND OF THE INVENTION

Electromagnetic pickups are devices that create a magnetic field in which strings of a musical instrument such as an electric guitar vibrate thereby disturbing the magnetic flux lines of the magnetic field. The pickups have at least one coil of wire which is connected to an amplifier. The disturbed, i.e., moving, flux lines caused by the vibrating strings cause minute electrical currents to flow in the wires of the coil, and these currents, cause a tiny voltage varying signal at the input to the power amplifier to which the coil is connected which reproduces the vibration of the strings electrically. This voltage is amplified to create a signal which drives speakers which reproduce the sounds made by the strings but at a much higher volume.

This would be all there is to it except for the problem of electrical noise. Electrical motors, 60 cycle per second utility system power and harmonics thereof, car ignitions and many other things cause electromagnetic flux variations in the atmosphere practically everywhere. This is in fact the basic theory of how radio waves propagate. These electromagnetic flux variations caused by things other than string vibration in the magnetic field of the pickup also cause electrical currents to flow in the pickup's coil. These undesired noise signals mix with the desired signals caused by the string vibration and degrade the quality of the resulting composite signal in that it is not pure string signal.

To combat noise, workers in the prior art have developed various pickup designs which are adapted to minimize noise pickup. The original noise cancelling pickup design in the prior art was made by Lover and patented as U.S. Pat. No. 2,896,491. This design was a side-by-side two-coil magnetic pickup. A first coil is designed to pick up mostly string signal but it also picks up some noise. A second coil is designed to pick up more noise than string signal. The first coil has a magnet which has a north polarity and the second coil has a magnet which has a south polarity. The coils are connected so that the signal from one coil is 180 degrees out of phase with the signal from the first coil when the two signals are added. In Lover, the string signals are additive because the opposite polarities create opposite phase string signals, but the out of phase connection of the coils reverses the effect of the opposite polarity thereby causing the string signals to add. This causes larger string signal output. However, hum signal in the coils is not caused by the magnetic field of the coil magnets so hum signal has the same polarity in both coils. Because the two coils are coupled so as to be 180 degrees out of phase, the hum signals cancel.

The disadvantage of the side-by-side arrangement of Lover is that the string signal is picked up by the two coils based upon vibrations at two different points in the string. Because high frequency harmonics have very short wavelengths, the string signal from these high frequency harmonics is not the same in both magnets. As a result, the low frequency harmonics whose wavelengths are long enough that the two different points problem has no effect will have their signal added whereas high frequency harmonics will not. This reduces the fidelity of the reproduction of the actual string vibrations and causes the pickup to have a muted sound which is lacking in detail.

Another example of a prior art noise cancelling pickup is U.S. Pat. No. 3,657,461 to Freeman. This was also a two-coil, noise-cancelling pickup with the coils stacked vertically and wrapped around bar magnets with a divider in between the coils.

More recently, U.S. Pat. No. 4,442,749 issued to DiMarzio et al. This patent taught a two-coil, noise-cancelling pickup with the coils stacked vertically and wrapped around a plurality of rod-like permanent magnets. The two coils were wrapped around a pair of superposed coaxial bobbins and oriented such that the axis of the coils was perpendicular to the plane of the strings. An integral plate of magnetic material is provided comprising a base disposed between the two bobbins perpendicular to the coil axis and the two side walls extending upward and perpendicular to the base to at least immediatly below the top face of the upper bobbin to act as a shield of the top coil. In other words, a shield of magnetic material having a plate parallel to the plane of the strings and separating the two bobbins was incorporated, and the plate had two vertical sidewalls orthogonal to the plane of the strings and covering the sidewalls of the upper coil to shield it from noise flux. The rod-like permanent magnets contact the base of the integral plate with all rod magnets having like polarity at the tops thereof. The upper and lower coils were wound in opposite directions so the noise signal generated by the lower coil was 180 degrees out of phase with the string signal. The idea was to use the shield to prevent noise electromagnetic fluctuations from reaching the top coil windings to generate currents therein. The signal from the bottom coil was not shielded and picked up noise signal which cancelled part of the noise signal from the top coil.

U.S. Pat. No. 4,524,667 to Duncan teaches a two-coil, noise-cancelling pickup where the two coils are vertically stacked around the permanent magnets which extend through the centers of the two windings. See FIG. 5 for the configuration. A switching circuit allows the two coils to be connected in either a single or dual coil configuration.

U.S. Pat. No. 5,668,520 to Kinman teaches a two-coil, noise-cancelling pickup with the axes of the coils coincident and using six magnetized rod permanent magnets extending as pole pieces up through the axis of the first coil coils and six non-magnetized pole pieces extending through the axis of the second coil, all pole pieces having long axes which are orthogonal to the plane of the strings. Both multiple rod magnet pole pieces and blade magnet pole pieces are disclosed. Two U-shaped shields which are back to back with sidewalls that shield the sides of the first and second coils serve in both embodiments to shield the first and second coils from each other both magnetically and inductively.

U.S. Pat. No. 5,834,999 to Kinman is a continuation-in-part of U.S. Pat. No. 5,668,520 and teaches a two-coil, noise-cancelling pickup with substantially the same configuration as the parent patent but the shield does not extend as far in the horitonal direction toward the end of the racetrack shaped (two long straightaways coupled by tight turns at the ends) coils.

U.S. Pat. No. 6,103,966 to Kinman is a continuation-in-part of U.S. Pat. No. 5,834,999 and teaches a two-coil, noise-cancelling pickup with substantially the same configuration as the parent patent but teaching a variety of different pole piece configurations.

U.S. Pat. No. 6,291,759 to Turner teaches a two-coil, noise-cancelling pickup comprising an upper bobbin, a ferromagnetic steel plate and a lower bobbin, stacked on top of each other, oriented longitudinally and laterally substantially the same, and held together by ferromagnetic screws. An upper coil is wound around a middle section of the upper bobbin, and a lower coil is wounded in an opposite manner around a middle section of the lower bobbin, whereby the upper and lower coils are connected in series. The upper and lower bobbins, and steel plate each include a plurality of coaxial apertures to receive corresponding permanent magnetic pole pieces that extend from the upper bobbin to the lower bobbin. The key difference over the prior art appears to be that the upper and lower bobbins include additional apertures to receive ferromagnetic cylinders to selectively change the tonal characteristics of the guitar. The pickups may include a pair of ferromagnetic plates (64 in FIG. 11) attached to the longitudinal sides of the lower bobbin that extend upwards to about the middle of the upper coil. These ferromagnetic plates are electrically insulated from the pole pieces. The purpose of the steel plates 64 is to concentrate the electromagnetic fields generated by the permanent-magnet pole pieces 62 around the coils 58 and 60 of the pickup 50. The concentrated electromagnetic fields around the coils 58 and 60 increase the coupling between the electromagnetic sensing of the string vibration and the voltage produced at the pickup electrical connection. This results in a more efficient generation of voltage at the coil ends or electrical connections of the pickup 50.

U.S. patent application Ser. No. 09/909,473 filed 4 Jul. 2002, published as U.S. 2002/0083819, inventor Kinman, teaches a low eddy current core in a noise cancelling pickup coil.

Other U.S. patents which teach related subject matter are: U.S. Pat. No. 3,236,930 to Fender teaching a single coil pickup with shaped sidewalls; U.S. Pat. No. 3,915,048 to Stich teaching a switching system for noise cancelling pickups; U.S. Pat. No. 4,026,178 to Fuller teaching a single coil pickup with shaped sidewalls; U.S. Pat. No. 4,133,243 to DiMarzio teaching a pickup with adjustable pole pieces; U.S. Pat. No. 4,220,069 to Fender teaching a single coil pickup with sidewalls; U.S. Pat. No. 4,283,982 to Armstrong teaching variations in magnet and coil placement in side-by-side noise cancelling design; U.S. Pat. No. 4,809,578 to Lace teaching a single coil pickup with sidewalls; U.S. Pat. No. 5,464,948 to Lace teaching a single coil pickup with sidewalls; U.S. Pat. No. 5,811,710 to Blucher teaching tapered/stepped sidewalls in a stack-type noise cancelling design; U.S. Pat. No. 5,908,998 to Blucher teaching teaches extra metal slugs to increase the inductance of the lower coil; and U.S. Pat. No. 6,111,185 to Lace teaching horizontal coils with side walls.

In the prior art of which the applicant is aware, both the upper and lower coils of the pickup are typically of the same physical size. In the most recent prior art, different approaches such as using different wire guages and different numbers of turns on the upper and lower coils in an attempt to reduce the size of the pickup without losing the hum cancellation tendancy of having a two coil pickup. Typically, the upper coil is wound with a high number of turns of a lighter guage wire and the lower coil is wound with a lower number of turns of a heavier guage wire. Hum cancellation is usually accomplished by some combination of shielding the upper coil with ferrous plate and/or increasing the inductance of the lower coil. Increasing the inductance of the lower coil is typically done by iron loading (adding extra iron beside the pole pieces in the central cavity of the lower coil). The intent of these different approaches is to decrease the amount of hum signal in the upper coil compared to the string signal and to increase the amount of hum signal in the lower coil such that this signal can be used to cancel hum signal in the upper coil. These prior art approaches have several shortcomings.

First, the upper and lower coils are always the same size. This is because the other techniques such as shielding and inductance maximization cannot alone create enough hum cancellation without having the upper and lower coils the same size. In other words, it is necessary to have the lower coil the same size as the upper coil in order to get enough hum signal in the lower coil to cancel the hum signal still left in the upper coil after shielding.

Second, it is highly desirable to emulate with a two-coil pickup the sound of a single coil pickup because musicians prefer the sound of the single coil pickup but hate hum. However, because both coils in the two coil pickups are the same size, and the lower coil is typically filled with iron load, the magnetic structure is necessarily significantly different from the single coil pickup. Two coil pickups have shorter pole length and a shorter coil profile, for example than single coil pickups. The different magnetic and mechanical structures produce different output and attach characteristics. However, the desire is to have a two coil pickup with the same sound as a single coil pickup but with less hum. Preferably, a two-coil stacked pickup which improves over the prior art would be small enough to retrofit into the pickup cavity of prior art stringed instruments.

Some prior art designs have tried to get closer to the sound of a single coil pickup by using high magnetic strength rare earth magnets in two coil pickups. But this high magnetic field results in excessive string damping (the strings are metal and are subjected to physical forces by the high magnetic field which alters their vibration pattern) and production of "false harmonics" both of which phenomena alter the sound of the guitar.

Third, because the upper string sensing coil is the same size as the lower coil, the upper sensing coil will always have a different geometry and wire guage from the traditional single coil pickup. This is because if the geometry were the same in the coils of a two coil pickup as in a single coil pickup, the two coil pickup would be much too large to fit in the space available for the pickup in traditional instruments without modifying the instrument. If the same wire guage were to be used in a two coil pickup as is used in traditional single coil pickups, the larger wire size would require that the two coil pickup coils would have fewer turns than the single coil pickup coil so that the two coil pickup could be made small enough to fit into the available space. The fewer number of turns means a smaller signal would be output from the pickup thereby requiring more amplification. A lower number of turns also gives a higher resonant frequency in addition to lower output. Both these characteristics alter the sound output from the pickup. Amplification also amplifies any residual hum signal in the pickup output so the hum becomes louder and more distracting. The shorter coil geometry forced on the two coil pickups by the space limitations means that the geometry of the single coil pickup is not faithfully reproduced which results in loss of faithful reproduction of the single coil pickup sound.

The prior art designs also fail to adjust for normal production variations in the manufacture of the pickups. The manufacturer will therefore have variations in hum signal from one pickup to the next, or, if strict quality control standards are imposed, a higher than normal reject rate.

SUMMARY OF THE INVENTION

The genus of the invention is defined by a two coil pickup for a stringed instrument with a ferrous flux transfer plate which shields the upper coil from magnetic flux variations caused by undesired noise and transfers those same noise flux variations into the lower coil. This maximizes the amount of noise signal generated in the lower coil and minimizes the amount of noise signal picked up by the upper coil.

In the preferred embodiment, the flux transfer plates are in two halves, each half with a vertical wall portion that covers the sides of the upper coil and a horizontal wall portion that separates the upper from the lower coil. Another vertical wall portion lies adjacent or is attached to a ferrous blade which is inserted into a center slot in a lower coil form around which the lower coil is wrapped. This shape causes a magnetic path of least resistance for noise flux variations from the vertical wall portions that encompass the upper coil down into the center of the lower coil. This causes less noise flux lines which are varying to cut across across the windings of the upper coil and more varying noise flux lines to cut across the windings of the lower coil. This generates noise current variations in the lower coil which can be used to cancel noise current variations in the upper coil since the upper and lower coils are connected so as to be 180 degrees out of phase with each other.

An important feature of this design is that it allows a large upper coil and a small lower coil to be used without losing effectiveness of noise cancellation. A small lower coil normally would cause loss of some noise cancellation but the use of the flux transfer plates to guide noise flux variations into the lower coil enables good noise cancellation properties despite the smaller lower coil size. The large upper coil, in the preferred embodiment, is structured to have very similar or identical geometry to traditional single coil magnetic pickups. This produces a nearly identical tone to the old single coil pickups that musicians love.

A trim pot variable resistor is coupled across the lower coil to vary the amount of noise signal which is applied to cancel noise signal in the upper coil.

DETAILED DESCRIPTION OF THE PREFERRED AND ALTERNATIVE EMBODIMENTS

Figure 1:
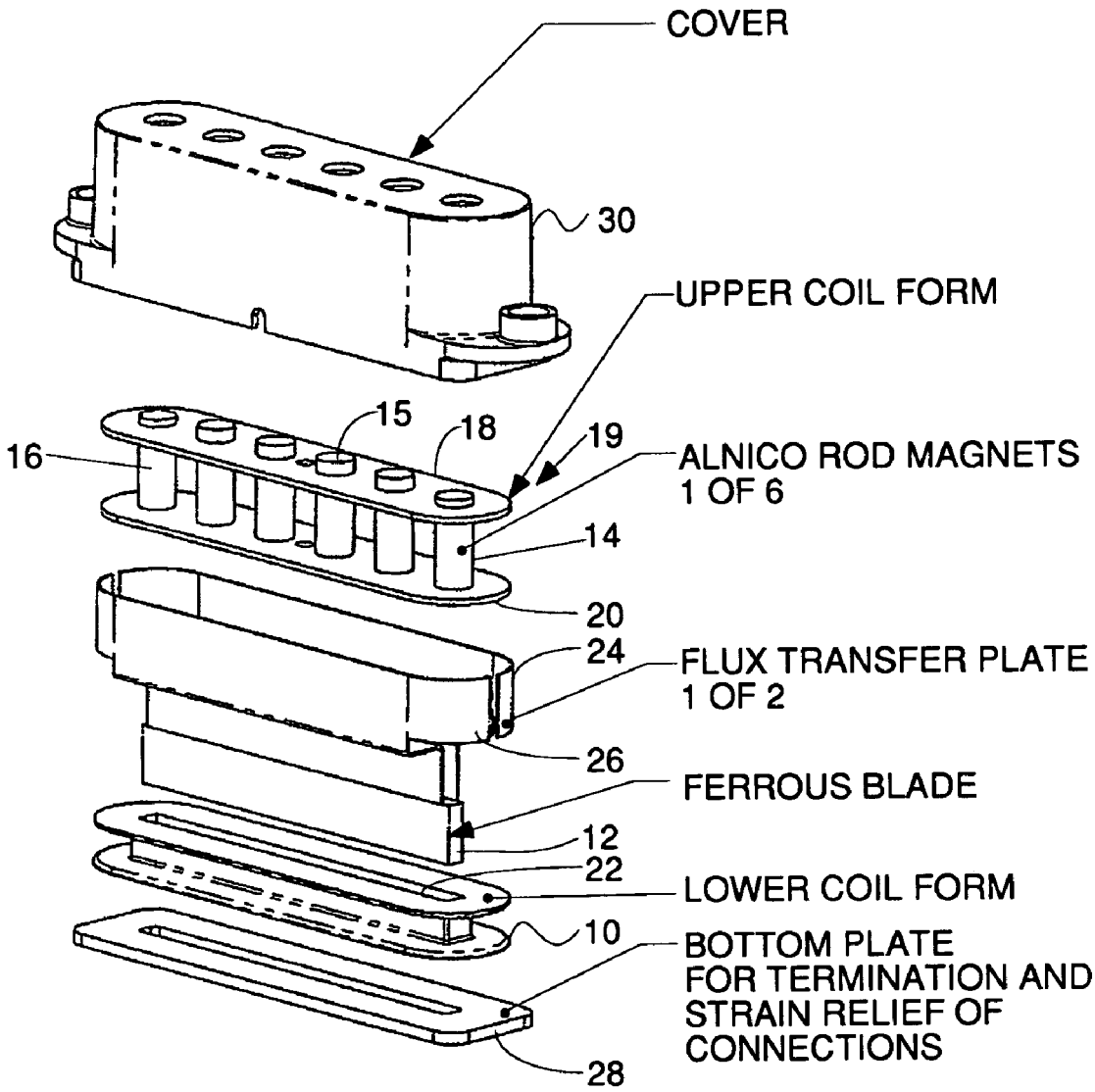
FIG. 1 is an exploded view of the pieces of the preferred form of a two-coil pickup according to the teachings of the invention.
Figure 2:
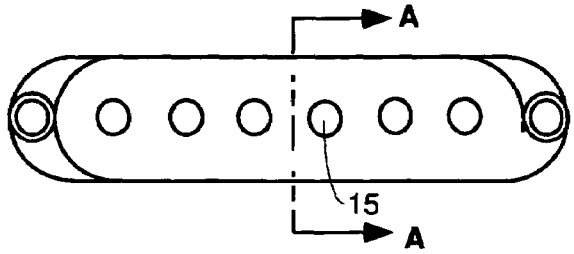
FIG. 2 is a top view of the pickup of FIG. 1.
Figure 3:
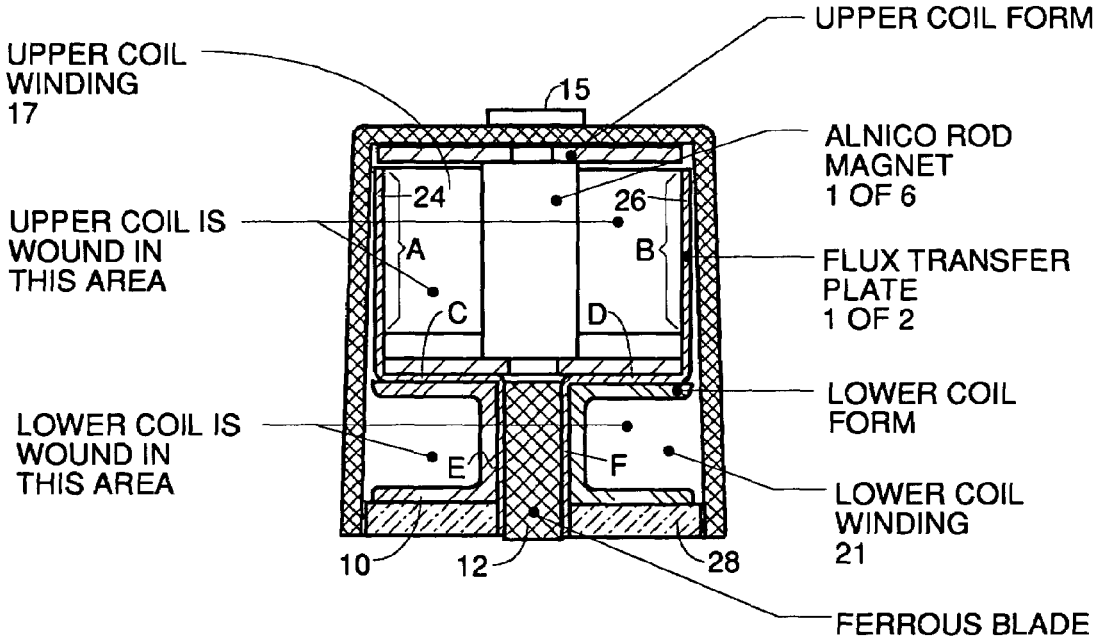
FIG. 3 is a cross-sectional view of the pickup of FIG. 1 taken along the section line A—A in FIG. 2.

Referring jointly to FIGS. 1, 2 and 3, the preferred embodiment of a two-coil pickup for a stringed instrument will be described. FIG. 1 is an exploded view of the pieces of the preferred form of a two-coil pickup according to the teachings of the invention. FIG. 2 is a top view of the pickup of FIG. 1. FIG. 3 is a cross-sectional view of the pickup of FIG. 1 taken along the section line A—A in FIG. 2.

A lower coil form 10 serves as a bobbin around which a lower winding (not shown) is wound to form the lower coil. The lower coil form 10 has a slot 22 formed therein in which a ferrous blade 12 is inserted when the pickup is assembled. The lower coil form 10 can be made of injection molded plastic, glass reinforced nylon or any other non ferrous or ferrous material. The preferred material for the lower coil form 10 is glass reinforced nylon which is a form of injection molded plastic. The lower coil form 10 does not have to be non ferrous, and it can be made of other ferrous materials such as ferrite, molded powered metal, a mix of polyurethane with iron filings or Metal Injection Molded steel. In one alternative embodiment discussed below, the bottom coil form 10 and flux transfer plate (24 and 26 in the embodiment of FIG. 1) is formed of ferrous material so as to be all one piece.

It is the job of the lower coil wound around form 10 and ferrous blade 12 to pick up more signal from magnetic flux variations caused by 60 cycle hum than signal caused by magnetic flux variations caused by vibrations of steel strings in a magnetic field. Why it does this will be explained further below in connection with the discussion of shield plates 24 and 26.

The lower coil form 10 is attached to a bottom plate 28 when the pickup is fully assembled. The bottom plate 28 can be any non ferrous material, and functions to provide termination, circuit connection and strain relief structure for the wires of the upper and lower coils (not shown). The preferred material for the bottom plate is FR4 circuit board which is copper plated on one side and has four via holes formed in the copper plating. The two wires coming out of each winding are each soldered into a via hole. The copper plating is etched in a printed circuit pattern so as to connect the two coils in series in a 180 degrees out-of-phase relationship. This is done by winding both the upper and lower coils in the same direction, but connecting the two finish wires of each coil together. This is the same thing as winding one coil in the opposite direction as the other coil and connecting the start wire of one coil to the finish wire of the other coil, which is an alternative embodiment.

A magnetic field in which the steel strings (not shown) of a guitar vibrate is caused by a plurality of Alnico rod magnets (Alnico 2 through 5 is the preferred magnet material) of which rod magnets 14, 15 and 16 are typical. Six rod magnets are used in the preferred embodiment. Ceramic rod magnets can also be used, but the magnetic intensity of the flux created at the strings should not be so high as to actually exert magnetic attraction forces on the strings which is high enough to dampen vibration and change the tonal quality of the string vibration.

The rod magnets such as 14 are held in parallel, vertical orientation (vertical in the sense it is used here means orthogonal to the plane of the strings) by an upper coil form comprised of an upper plate 18 and a lower plate 20. The upper and lower plates 18 and 20 can be any non ferrous material such as plastic, wood, glass, fiberglass, glass reinforced nylon. Ferrous materials should not be used for upper and lower plates 18 and 20 because it tends to shield the coil wires from the magnetic flux variations created by the vibrating strings. A ferrous top plate would also tend to shunt the magnetic field of the pole pieces away from the strings, thus reducing the output of the string signal. The preferred material for the upper and lower plates is FR4 circuit board which is copper plated on one side (the outer side away from the windings). The copper plating is non ferrous and tends to shield the upper winding from being affected by high frequency harmonics on the power lines above 180 Hz. These higher frequency harmonics tend to have shorter wavelengths and do not affect both the upper and lower coil equally so as to have a 180 degree out-of-phase, cancelling relationship. Therefore, it is preferred to keep them out of the upper coil by using electrostatic, non-ferrous shielding. The copper plating is not essential to the invention, and can be eliminated.

The combination of the upper and lower plates 18 and 20 with the Alnico magnets 14 etc., form an upper coil form indicated generally at 19. After winding with wire of the upper winding (not shown) around coil form 10 in winding space 17 in FIG. 3, the upper coil is formed.

The upper coil form 19 sits on top of the lower coil form 10 but is separated therefrom by the ferrous bottom walls (C and D in FIG. 3) of a flux transfer plate (comprised of plate halves 24 and 26 in FIGS. 1 and 3) for reasons to be discussed below. The rod magnets, such as 15 in FIG. 3, do not extend below the bottom walls C and D of the flux transfer plates so as to prevent injection of desired flux fluctuations from string vibration into the lower coil winding 21. That is, the rod magnets terminate the flux lines that surround the strings, so if part of the rod magnets were to extend down into the lower coil form, part of the magnetic flux variation caused by the string vibrations would cross the windings of the lower coil and inject string signal into the lower coil. This is not desirable.

A ferrous magnetic shield which serves both as a shield and a flux transfer plate is formed in two halves shown at 24 and 26 in the embodiment of FIG. 1. The bottom of each of the flux transfer plate sections attaches or rests adjacent to (during the final assembly state shown in FIG. 3) the sides of the ferrous blade 12 so as to guide flux into the ferrous blade 12. The sides of the flux transfer plates shield the upper coil winding 17, so any flux variations caused by 60 cycle hum and other undesired noise enter the flux transfer plate (because it is more magnetically permeable than air) and get guided to ferrous blade 12 which injects the hum flux variations into the center of lower coil winding 21. This shields the upper coil winding 17 from undesired noise and injects it into the lower coil winding 21. Mild steel or any highly magnetically permeable (more permeable than air, preferably substantially more permeable than air) may be used for the flux transfer plates 24 and 26.

Figure 4:
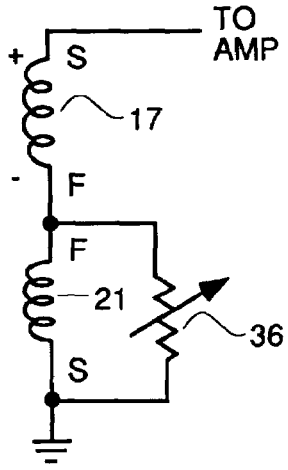
FIG. 4 is a circuit diagram showing the electrical connection of the two coils so as to be out of phase and the trim pot variable resistor.

As can be gathered from the above discussion, one purpose of the flux transfer plates 24 and 26 is to shield the windings of the upper coil wrapped around the upper coil from from magnetic flux variations caused by undesired noise such as 60 cycle hum and to divert those flux variations caused by undesired noise into the center of the lower coil. The second function of the flux transfer plates is to "localize" the magnetic circuit of the upper coil in order to focus the string generated flux variations in the upper coil. The third function of the flux transfer plate (and the bottom plates C and D in particular) is to shield the bottom coil from magnetic flux variations caused by vibration of the steel strings in the magnetic field caused by the rod magnets. The reason for this shielding configuration is to minimize undesired noise in the output signal of the pickup at two terminal points (not shown) on the bottom plate 28. The two coil pickup design has an upper coil which is wrapped in one direction around the upper coil form 19 and is designed to generate signal (varying currents) as magnetic flux variations caused by string vibration cut across the windings of the upper coil. This is the desired signal. Any flux variations caused by 60 cycle hum or other undesired noise which cut across the windings of the upper coil winding 17 also generate current variations in the upper coil winding 17 which are superimposed upon the desired signal by superposition and degrade the quality thereof. The purpose of the lower coil is to cancel out as much of this undesired noise signal from the final output signal as is possible. To that end, the lower coil winding 21 is wound around the lower coil form 10 in the same direction as the windings 17 of the upper coil, but connected so as to be out of phase, as shown in FIG. 4. That is, the upper and lower coils are connected in series but 180 degrees out of phase.

This 180 degrees out of phase relationship between the signals from the upper coil 17 and the lower coil 21 and the shielding to guide noise flux variations into the lower coil winding 21 and keep them out of the upper coil winding 17 are the heart of the invention. This out-of-phase relationship causes the noise signal generated in the lower coil to cancel all or part of the noise signal in the upper coil thereby leaving mostly desired string signal at the output of the pickup.

The flux transfer plates 24 and 26 function of guiding noise flux to the lower coil winding 21 happens because of the configuration of the shield 24 and 26 and the fact that the shield is made of highly magnetically permeable material. This means that it is much easier for magnetic flux to travel through the material of the flux transfer plates 24 and 26 than through the air. Therefore, noise flux variations take the path of least resistance and are guided into the center of the lower coil winding 21 and mostly stay out of the upper coil winding 17.

The preferred material for the shield is steel. The two halves 24 and 26 of the flux transfer plate can be sheet steel which is stamped to have the correct form.

The preferred embodiment of the flux transfer plate 24 and 26 is shown in FIG. 3 as having upper vertical walls A and B. These upper walls A and B shield the windings of the upper coil 17 from being immersed in flux variations caused by 60 cycle hum. Bottom horizontal wall sections C and D shield the lower coil from flux variations caused by the string vibration in the flux caused by the rod magnets. Wall sections E and F guide the flux variations caused by noise along the vertical walls of the ferrous blade 12 and into the center of the lower coil 21.

A plastic cover 30 covers the whole assembly.

FIG. 4 is a circuit diagram showing the electrical connection of the two coils so as to be out of phase and shows the connection of trim pot variable resistor 36. The upper coil winding 17 has start and finish wires marked S and F. The lower coil winding 21 also has start and finish wires S and F. The two finish wires are connected together to create the 180 degrees out of phase relationship. This connection is implemented via a conductive trace on bottom plate 28 in FIG. 1. A variable resistor trim pot 36 is coupled across the lower coil 21. The trim pot 36 can have its resistance varied so as to vary the amount of cancellation of noise signal which is provided by the lower coil winding 21. This allows manufacturers variations in the degree of noise cancellation between different lots of pickups to be managed by factory testing and setting of the trim pot resistance to provide the most effective cancellation in each lot or each pickup. Typically, the upper coil winding 17 has more inductance than the lower coil winding 21. This is different than many of the prior art references which stress matching the core materials and number of windings and wire size of the upper and lower coils so as to achieve as exact a match in DC resistance, capacitance and inductance of the two coils as is possible. This is believed to be stressed so that the noise signal generated in the lower coil can be as close as possible to the same magnitude as the noise signal generated in the upper coil. This was thought in the prior art to improve the degree of cancellation to as close as perfection as possible.

The problem with this prior art approach of making both coils the same size is that it requires both coils to be made smaller than the single coil of a traditional pickup. This must be done so that the overall two coil pickup structure can still fit in the pickup cavity of stringed instruments without modification of the instrument. Unfortunately, when the upper coil that picks up the string signal is made smaller than the traditional single coil pickup, the resulting tone quality from the smaller two coil pickup will not be the same as from the beloved single coil traditional pickups. The invention eliminates this problem by making the upper coil the same size and geometry as traditional single coil pickups, and making the lower coil smaller to meet size requirements but making it more effective to pick up hum by use of the flux tranfer plates.

In contrast, the preferred embodiment of the invention uses an upper coil which is significantly larger than the lower coil, but uses the flux transfer plates 24 and 26 to keep most of the noise flux variations out of the upper coil and diverted to the magnetically permeable core of the smaller lower coil. Thus, the amount of noise cancellation caused by the smaller lower coil is just as much or more than in the prior art two coil pickups. This smaller lower coil also provide enough additional space as compared to prior art two coil pickups to allow the upper coil to be wound with a number of turns and wire guage which closely or exactly match the number of turns and wire guage of the traditional single coil pickups which musicians love. Wire guage affects a coil's DC resistance. Spacing between the centers of adjacent turns affects the inter-turn capacitance of a coil. The use of the flux transfer plates allows the use of a much smaller lower coil thereby providing the aforementioned benefit in the geometry and electrical characteristics of the upper coil possible. The large upper coil and small lower coil of the invention also places the lower coil further away from the strings than in prior art two-coil pickups. This is desirable because the further away from the strings the lower coil is, the less is the amplitude of the desired string signal which is picked up in the lower coil. Any string signal that is picked up in the lower coil cancels part of the desired string signal output by the upper coil. The overall result is a hum bucker two-coil pickup with excellent noise performance which is better than the noise performance of a single coil pickup but which still sounds very much like a single coil pickup.

Use of the flux transfer plates also has other advantages. Since the rod magnets in the invention are slightly shorter than in traditional single coil pickups to allow an overall package size which is close to that of a single coil pickup, the magnetic field intensity generated by the rod magnets is less. Keeping the overall package size the same as single coil pickups avoids forcing the player to set his guitar up differently that he is used to in order to accommodate an oversize pickup. If the two coil stacked pickup were to be bigger than a single coil pickup, the player would be forced to locate the pickup significantly closer to the strings than is the case for single coil pickups. This would hamper the player's playing style and further change the tone of the pickup. The shorter magnets in the two coil stacked pickup of the invention keep the top of the pickup far enough away from the strings to avoid irritating the player.

Importantly, a less intense magnetic field around the strings leads to loss in amplitude of the signal output by the pickup. The use of the flux transfer plates tends to concentrate the magnetic flux intensity generated by the rod magnets toward the strings leading to little or no loss of intensity of the magnetic field intensity at the strings. Further, because the flux transfer plates focus the magnetic field and form a less open magnetic circuit around the upper coil, and because of the configuration of the flux transfer plates, the lower coil is more isolated from magnetic flux variations caused by the strings. Therefore, the amount of string signal generated in the lower coil (a bad thing) is reduced. This is important because the lower coil is 180 degrees out of phase with the upper coil, and any string signal in the lower coil will cancel out part of the string signal in the upper coil. Therefore, placing the lower coil further away from the strings and shielding it from string-based flux variations decreases the amount of string signal generated in the lower coil. If the lower coil were to have significant string signal developed therein which cancelled part of the string signal of the upper coil, this would represent a significant drop in the overall signal-to-noise ratio of the output signal of the pickup and would cause it to vary considerably from the tone and performance of a single coil pickup.

Use of the trim pot 36 make it possible to "over wind" the lower coil and then put a trim pot in parallel with it. The trim pot is then adjusted until the maximum hum canceling effect is achieved. The use of the trim pot has several advantages. First, the trim pot can be adjusted on each pickup to cancel out differences in performance caused by production variations from one pickup to the next thereby allowing maximum hum cancellation from each pickup. Also, having the trim pot in parallel reduces the DC resistance contribution of the lower coil to the total DC resistance of the pickup. The DC resistance of the lower coil is a penalty because it reduces the output of the pickup because the currents induced in the upper coil by string flux fluxuations get converted to voltage drop across the lower coil as the current flows through the DC resistance of the lower coil. Lowering the DC resistance of the lower coil lessens the magnitude of the voltage drop of the desired string signal generated in the upper coil which undesirably cancels part of the string signal of the upper coil. The result is less undesired cancellation of part of the string signal generated in the upper coil. Minimizing undesired string signal cancellation is an advantage.

The configuration of FIG. 4 is totally passive. In alternative embodiments, the two coil signals may be input to an analog difference amplifier to subtract the lower coil signal from the upper coil signal or a digital signal processor and digitization circuitry could be used to subtract the two signals from each other in alternative embodiments.

Figure 5:
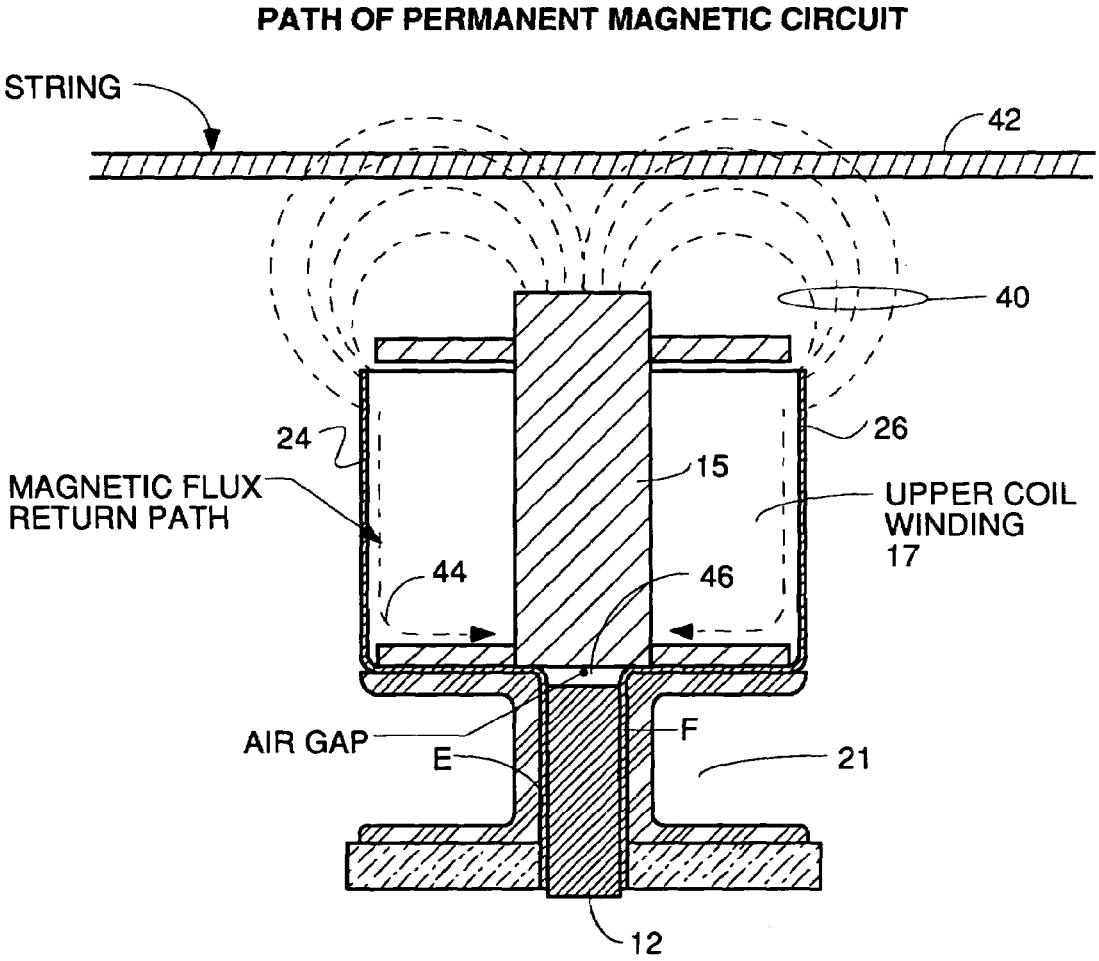
FIG. 5 is a diagram of the flux path caused by the flux transfer plates for the magnetic flux lines affected by the guitar strings.

FIG. 5 is a diagram of the flux path caused by the flux transfer plates for the magnetic flux lines affected by the guitar strings. Magnetic flux lines 40 emerge from one magnetic pole of the rod magnets such as 15 and envelop magnetically permeable guitar string 42. The flux lines then return toward the other pole of the rod magnets, and are guided thereto by the flux transfer plates 24 and 26. Because the magnetic path through the flux transfer plates is easier than through air, the flux lines 40 tend to concentrate in the flux transfer plates 24 and 26, as represented by arrow 44, as they travel toward the bottom pole of the rod magnets. Because the flux lines want to return to the bottom pole of the rod magnets, they tend not to enter the lower coil winding 21 or the ferrous blade 12 or the segments E and F of the flux transfer plates in the core of the lower coil winding 21. This phenomenon is slightly aided by the presence of air gap 46, but that air gap could be eliminated in alternative embodiments.

Figure 6:
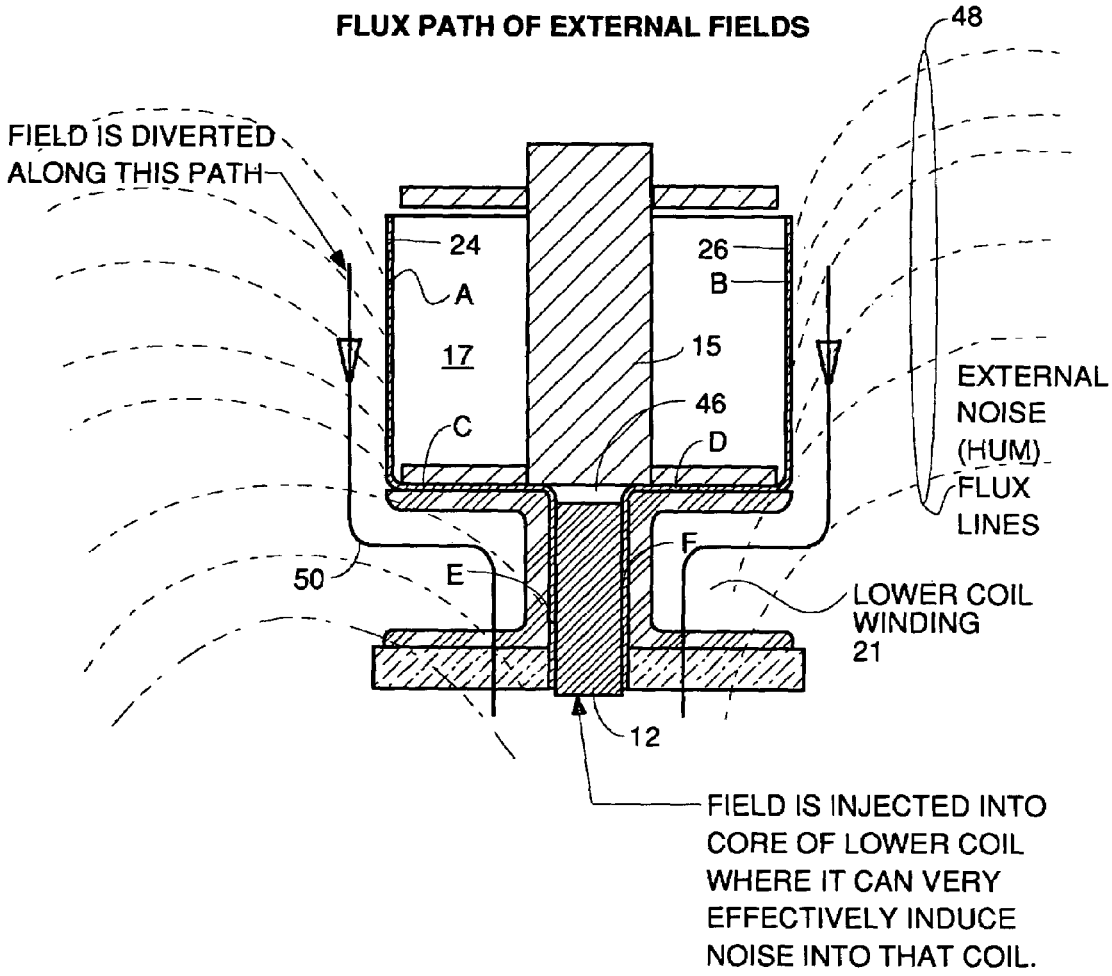
FIG. 6 is a diagram of the flux path of external noise flux fields such as 60 cycle hum caused by 120 volt wall power currents flowing to various circuits and showing how the flux transfer plates guide these noise flux lines into the lower coil 21.

FIG. 6 is a diagram of the flux path of external noise flux fields such as 60 cycle hum caused by 120 volt wall power currents flowing to various circuits and showing how the flux transfer plates guide these noise flux lines into the lower coil 21. External noise magnetic flux lines 48 exist everywhere and are caused by electrical currents flowing through conductors external to the pickup such as wall power flowing through extension cords to guitar amplifiers, etc. When these external noise flux lines 48 encounter the magnetic pickup, the are diverted by the magnetically permeable vertical walls A and B of the flux transfer plates 24 and 26 away from the windings of the upper coil 17 and toward the horizontal wall sections C and D. These horizontal wall sections C and D are also more magnetically permeable than the air and other structures around them and guide the noise flux lines to the vertical wall sections E and F in the core of the lower coil winding 21 and the ferrous blade 12. Arrow 50 represents the path along which the external noise flux lines are diverted. This causes most of the noise signal voltage to be generated in the lower coil winding 21 and not in the upper coil winding 17.

Figure 7:
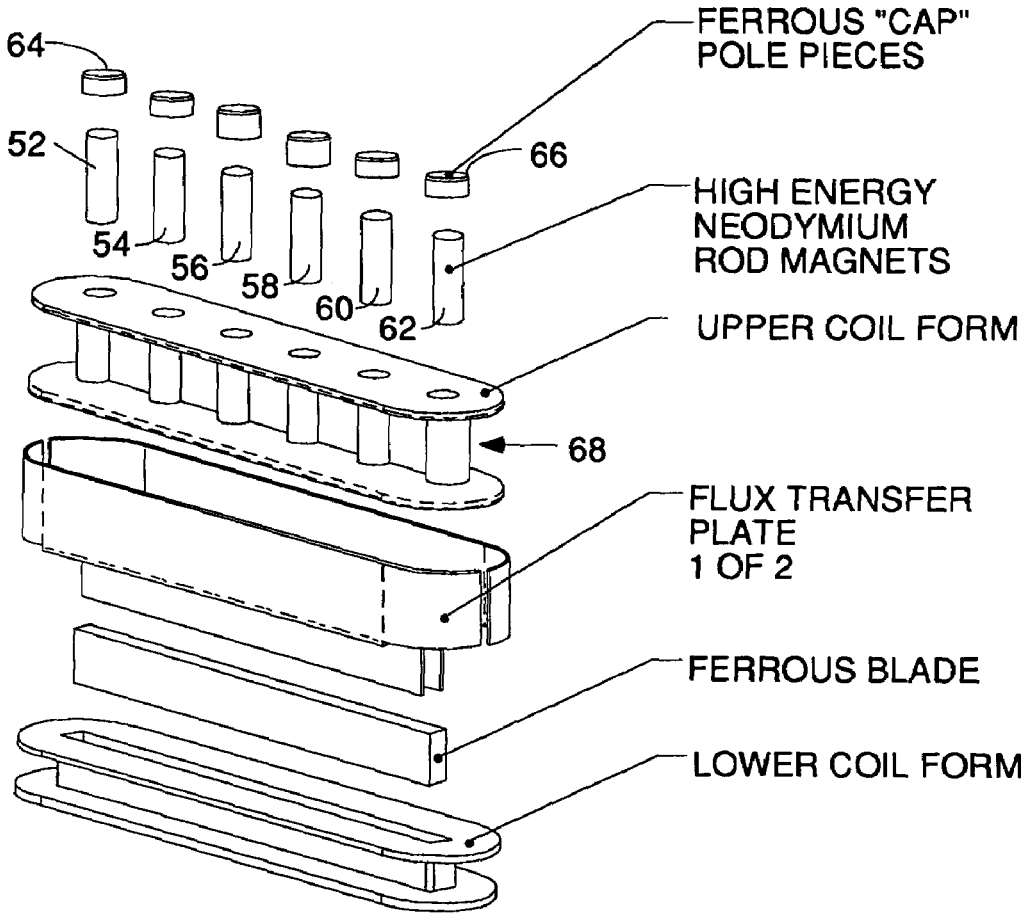
FIG. 7 is an exploded view of an alternative embodiment of a two-coil pickup according to the teachings of the invention which uses rare earth neodymium rod magnets to provide a stronger magnetic field to envelope the strings.

FIG. 7 is an exploded view of an alternative embodiment of a two-coil pickup according to the teachings of the invention which uses rare earth neodymium rod magnets to provide a stronger magnetic field to envelope the strings. Everything in the embodiment of FIG. 7 is the same as is shown in the embodiment of FIG. 1 except that high energy neodymium rod magnets 52, 54, 56, 58, 60 and 62 are used instead of the lower strength rod magnets of the embodiment of FIG. 1. Each neodymium rod magnet has a ferrous slug cap or pole piece of which caps 64 and 66 are typical. The advantage of using high strength rare earth magnets is that it allows a smaller cross-sectional area of the core of the bobbin for the upper winding 17. This allows use of a less expensive molded bobbin for the upper coil form 68 by creating more winding space. The ferrous slugs or caps 64 can be eliminated, but they provide wider distribution of the magnetic flux and provide the pickup with the appearance of a traditional pole piece.

Figure 8:
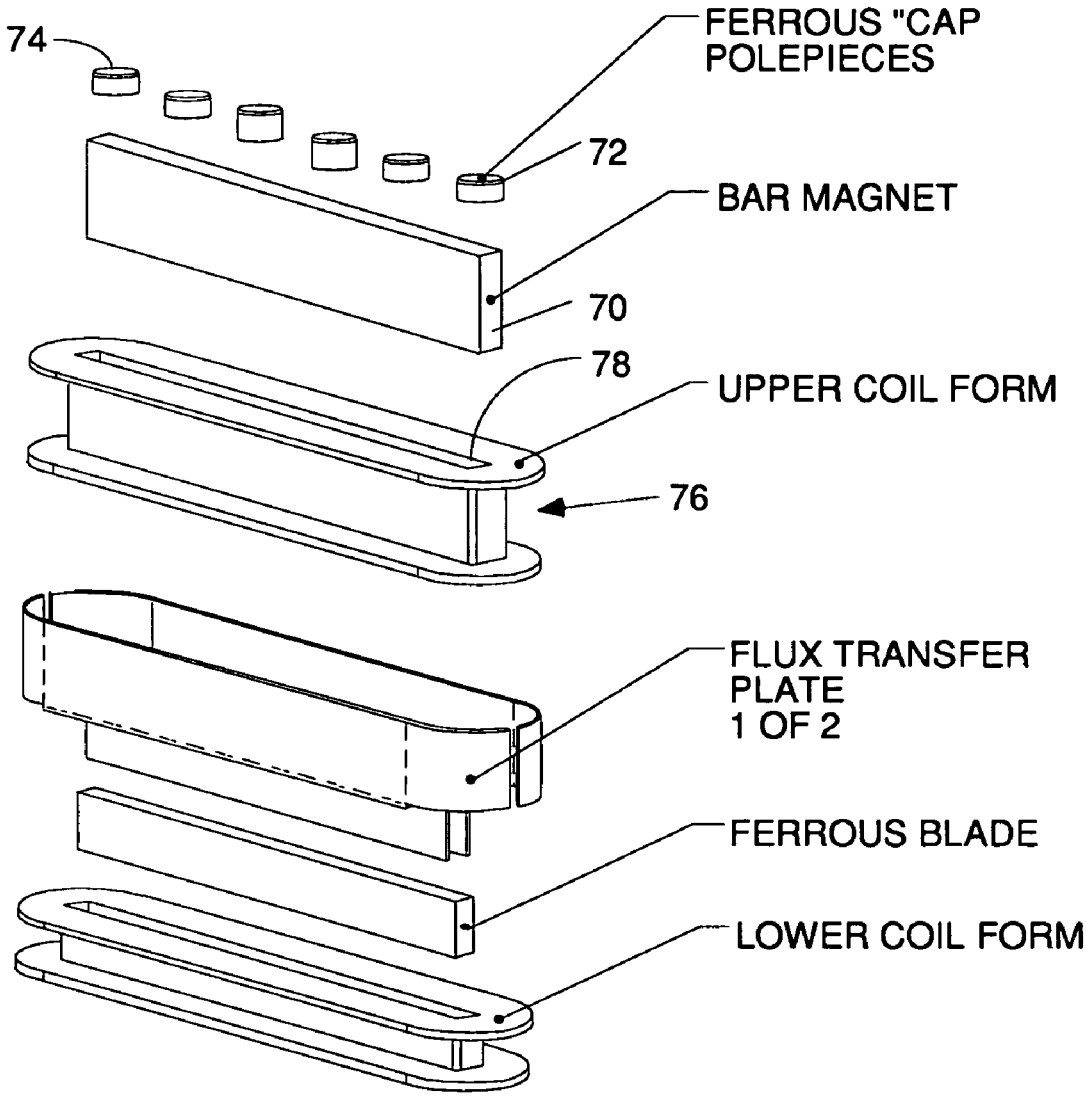
FIG. 8 is an exploded view of a second alternative embodiment of a two coil pickup having a bar magnet instead of rod magnets.

FIG. 8 is an exploded view of a second alternative embodiment of a two-coil pickup having a bar magnet instead of rod magnets. In this embodiment, bar magnet 70 is used instead of individual rod magnets, and six optional ferrous cap pole pieces, of which 74 and 72 are typical, are used to provide the appearance of a conventional pole piece. The bar magnet slides into a slot 78 in upper winding bobbin 76. Bar magnet 70 is preferably made of a ceramic material which is a cheaper magnetic material than the rod magnets and the rare earth rod magnets. Because ceramic has a lower ferrous content than the rod magnets, the inductance of the upper coil winding 17 is less in this embodiment. This causes the amount of unwanted hum signal induced in the upper coil winding 17 to be less.

Figure 9:
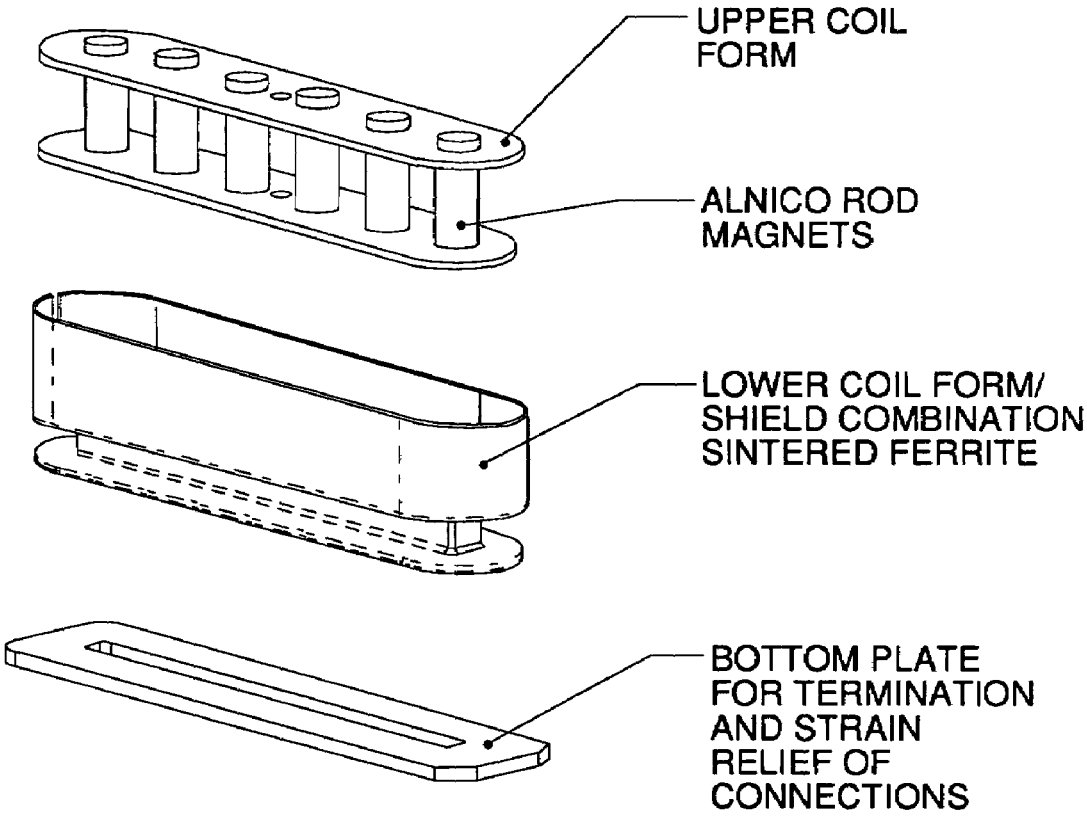
FIG. 9 is an exploded view of a third alternative embodiment of a two-coil pickup having a one piece combined shield and lower coil bobbin.

FIG. 9 is an exploded view of a third alternative embodiment of a two-coil pickup having a one piece combined shield and lower coil bobbin. In the embodiment of FIG. 9, the upper coil form and alnico magnets are used as in FIG. 1 although any of the other alternative embodiments for the upper coil form and magnet(s) could also be used in various subspecies of the species in FIG. 9. The main change from the other embodiments is that instead of separate flux transfer plate halves and a ferrous blade and a lower coil form, a one-piece, transfer plate and combined lower coil bobbin 80 is used. The one piece shield/bobbin 80 could be made of sintered-ferrite, or powdered metal or cast in a rubber mold from ferrous flakes encapsulated in a polyurethane matrix. The advantage of this embodiment is lower labor costs to assemble the pickup, and more efficient transfer of hum flux to the lower coil winding because of the monolithic construction resulting in an absence of air gaps. Depending upon the material selected for the shield/bobbin, it may even be possible to minimize eddy current losses in the lower coil.

Figure 10:
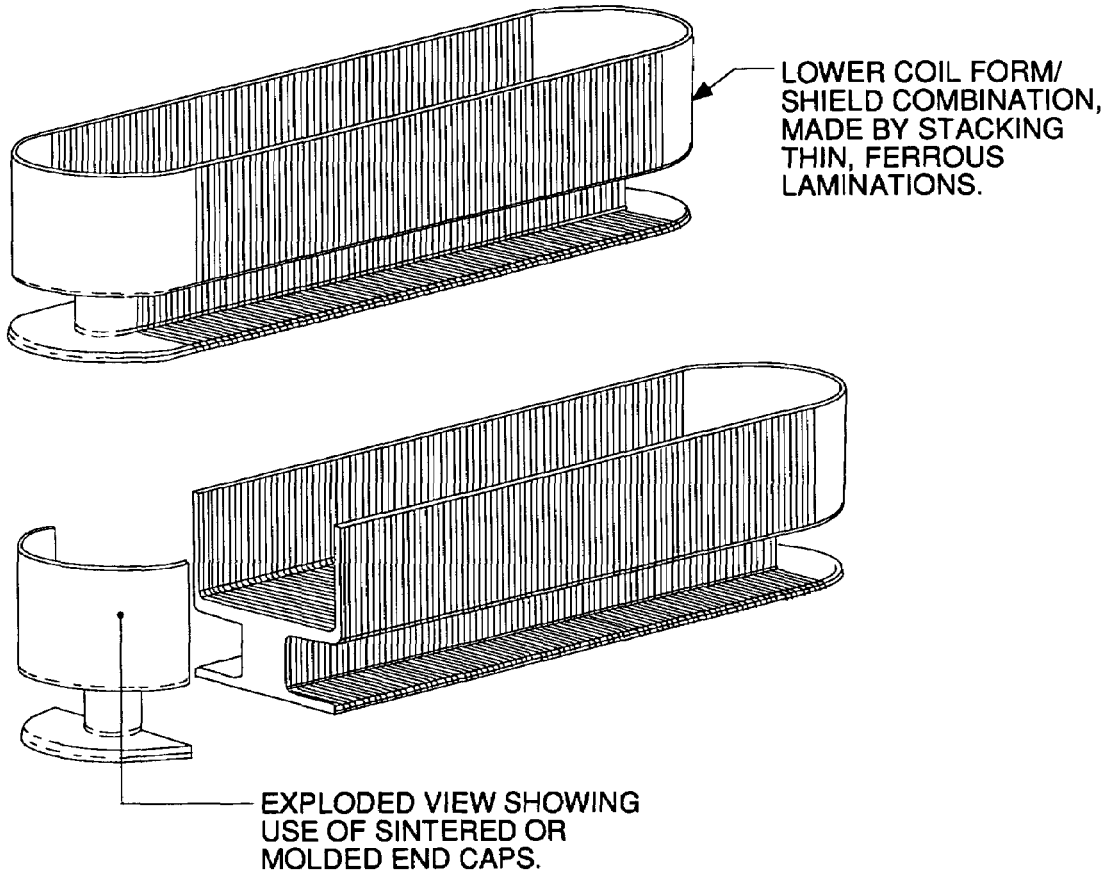
FIG. 10 shows a core structure which combines the shield structure with the lower coil bobbin in one laminated structure to reduce eddy currents in the lower coil and further improves efficiency.

FIG. 10 shows a core structure which combines the shield structure with the lower coil bobbin in one laminated structure to reduce eddy currents in the lower coil. The laminated shield/bobbin structure of FIG. 10 may be used as an alternative species for any of the species shown in FIGS. 1, 7, 8 or 9. The combined shield/bobbin structure takes the same shape as shown in the embodiment of FIG. 9 but is laminated into parallel slices of ferrous material each of which looks like a football goalpost with a footing. Because of the monolithic structure, more efficient hum transfer results, and the laminations significantly reduce eddy current losses in the lower coil.

Although the invention has been disclosed in terms of the preferred and alternative embodiments disclosed herein, those skilled in the art will appreciate possible alternative embodiments and other modifications to the teachings disclosed herein which do not depart from the spirit and scope of the invention. All such alternative embodiments and other modifications are intended to be included within the scope of the claims appended hereto.

What is claimed is:

1. An improvement in stringed musical instrument hum-bucking electromagnetic pickups having a pickup coil surrounding a pickup core region containing a permanent magnet system linking strings of the instrument, and having a hum-bucking coil surrounding a hum-bucking core region disposed in co-linear alignment with the pickup core region and containing a magnetically permeable core-piece, the hum-bucking coil being interconnected in opposing polarity with the pickup coil so as to provide cancellation of unwanted hum interference as a tradeoff for an amount of tonal degradation due to audio circuit intrusion of the hum-bucking coil, the improvement comprising:

a flux transfer structure of magnetically permeable material having a first portion surrounding at least a major portion of the pickup coil externally, and a second portion disposed internally within the hum-bucking coil in the core region therof, contacting and surrounding at least a major portion of the core-piece, the first and second portions being seamlessly and continuously interconnected by an intermediate offsetting portion so as to form overall a funnel shape such that a set of environmental hum and noise flux lines within a total extent of the first portion having a cross sectional area approximating that of the pickup coil are caused to become compressed and intensified into a much smaller cross-sectional area in the core region of the hum-bucking coil containing the core-piece, thus intensifying flux density in the hum-bucking core region in an unusually efficient and effective manner due to the seamless interconnection provided by the intermediate offsetting portion; and the hum-bucking coil having substantially fewer coil winding turns and thus able to made in smaller size than the pickup coil, due to effectiveness of said flux transfer structure, consequently providing a reduction in both overall pickup size and in the amount of amount of tonal degradation due to audio circuit intrusion of the hum-bucking coil.

2. The improvement in stringed musical instrument electromagnetic pickups as defined in claim 1 wherein the cross-sectional area of the first portion of said flux transfer structure disposed outside the pickup coil is at least five times greater than the cross-sectional area of the second portion of said transfer structure disposed inside the hum-bucking coil in the core region thereof.

3. The improvement in stringed musical instrument electromagnetic pickups as defined in claim 1 wherein said flux transfer structure comprises:

a pair of magnetically permeable flux transfer plates disposed in mirror image relationship externally along opposite sides of the electromagnetic pickup, each plate configured with a stepped cross-sectional shape having a first planar portion joined seamlessly via an intermediate step portion to a second planar portion thus offset from the first portion, the first portions being disposed flanking said pickup coil externally and the second portions being disposed within the second core region flanking said core-piece.

4. The improvement in stringed musical instrument electromagnetic pickups as defined in claim 3 wherein:

the first planar portions of said flux transfer plates are parallel and are spaced apart by a first separation dimension; and the second planar portions of said flux transfer plates are parallel and spaced apart by a second separation dimension that is smaller than the first separation dimension by a factor of at least five times.

5. The improvement in stringed musical instrument electromagnetic pickups as defined in claim 1 further comprising:

said hum-bucking coil being wound with additional turns greater than a nominal number of turns required for total hum-bucking cancellation effect; and an adjustable resistor, connected in conjunction with said hum-bucking coil, made and arranged to provide adjustment for maximizing hum-bucking cancellation effect.

6. An electro-magnetic pickup for sensing vibration of magnetically permeable strings of a stringed musical instrument and generating audio signals therefrom, comprising:

a pickup coil surrounding a pickup core region of designated length having an end facing the strings;

at least one permanent magnet, disposed in the pickup core region, magnetically linked to associated strings in a manner to generate an audio signal induced in the pickup coil from vibration of the strings when the instrument is played, thus providing an audio output signal for amplification;

a hum-bucking coil surrounding a hum-bucking core region located adjacent to and aligned with the pickup core region at an end thereof opposite the end facing the strings;

said hum-bucking coil being interconnected with said pickup coil in opposite polarity so as to tend to cancel effects of unwanted environmental magnetic flux lines representing hum and noise disturbances traversing the two core regions;

a flux transfer structure having a first portion externally surrounding at least a major portion of said pickup coil, a second portion disposed within the hum-bucking core region, surrounding at least a major portion of said core-piece, and an intermediate portion interconnecting the first and second portions contiguously and seamlessly, said flux transfer structure being made and arranged to transfer a set of flux lines encompassed by the first portion into a much smaller cross-sectional area encompassed by the second portion and consequently at greatly intensified flux density, in an unusually efficient and effective manner due to the seamless interconnection provided by the intermediate portion;

a magnetically permeable core-piece disposed within the hum-bucking core region;

said hum-bucking coil having substantially fewer coil winding turns and smaller size than said pickup coil, as enabled by unusual effectiveness of said flux transfer structure;

whereby tonal quality is improved to closer approach that of single coil pickups, and smaller overall pickup size creates possibility of deployment in instrument cutouts dimensioned for single coil pickups.

7. The electro-magnetic pickup as defined in claim 6 wherein said flux transfer structure comprises:

a pair of magnetically permeable flux transfer plates disposed in mirror image relationship on opposite sides of said pickup, each plate being configured with a stepped cross-sectional shape having a first planar portion joined seamlessly via an intermediate step portion to a second planar portion thus offset from the first portion, the first portions being disposed flanking said pickup coil externally and the second portions being disposed internally within the second core region flanking said core-piece such that each of the flux transfer structure extends continuously and seamlessly over a full extent of said pickup coil and said hum-bucking coil.

8. The electro-magnetic pickup as defined in claim 6 further comprising:

said hum-bucking coil being wound with additional turns greater than a nominal number of turns required for maximum hum-bucking cancellation effect; and an adjustable resistor, connected in conjunction with said hum-bucking coil, made and arranged to provide adjustability for maximizing hum-bucking cancellation effect.

9. A method of processing undesired electromagnetic flux lines for improved tonal quality and more compact overall size in stringed musical instrument hum-bucking electromagnetic pickups having a pickup coil with a pickup core region containing a permanent magnet system linking strings of the instrument, and having a hum-bucking coil adjacent the pickup coil and connected in opposition thereto, the hum-bucking coil having a hum-bucking core region aligned with the pickup core region, the method comprising the steps of:

incorporating a magnetically permeable core-piece disposed within the hum-bucking core region; and incorporating a flux transfer structure having a first portion externally surrounding at least a major portion of the pickup coil, a second portion disposed within the hum-bucking core region, surrounding at least a major portion of the core-piece, and an intermediate portion interconnecting the first and second portions contiguously and seamlessly, the flux transfer structure being made and arranged to provide a flux-funneling effect tending to transfer a set of flux lines encompassed by the first portion into a much smaller cross-sectional area within the hum-bucking core region encompassed by the second portion and accordingly at greatly intensified flux density, in an unusually efficient and effective manner due to the seamless interconnection provided by the intermediate portion;

making the hum-bucking coil with substantially fewer turns than the pickup coil as enabled by the seamless flux transfer structure, thus improving tonal response of the pickup; and making the hum-bucking coil substantially smaller in size than the pickup coil regarding core length and thus reducing overall size of the pickup, as enabled by the fewer turns in the hum-bucking coil.

10. The method of processing undesired electro-magnetic flux as defined in claim 9 wherein the flux transfer structure comprises:

a pair of magnetically permeable flux transfer plates disposed in mirror image relationship on opposite sides of said pickup, each plate being configured with a stepped cross-sectional shape having a first planar portion joined seamlessly via an intermediate step portion to a second planar portion thus offset from the first portion, the first portions being disposed flanking said pickup coil externally and the second portions being disposed internally within the second core region flanking the core-piece such that each of the flux transfer structure extends continuously and seamlessly over a full extent of the pickup coil and the hum-bucking coil.

11. The method of processing undesired electro-magnetic flux as defined in claim 9 comprising the further steps of:

winding the hum-bucking coil with additional turns greater than a nominal number of turns required for maximum hum-bucking cancellation effect; and connecting an adjustable resistor in conjunction with the hum-bucking coil so as to provide adjustability for maximizing hum-bucking cancellation effect.

* * * * *